US010195627B2

(12) United States Patent
Becker et al.

(10) Patent No.: US 10,195,627 B2
(45) Date of Patent: Feb. 5, 2019

(54) SPRAY TIP STORAGE

(71) Applicant: Graco Minnesota Inc., Minneapolis, MN (US)

(72) Inventors: Steven D. Becker, Blaine, MN (US); Pamela J. Muetzel, Otsego, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 15/111,372

(22) PCT Filed: Jan. 20, 2015

(86) PCT No.: PCT/US2015/011977

§ 371 (c)(1),
(2) Date: Jul. 13, 2016

(87) PCT Pub. No.: WO2015/109296

PCT Pub. Date: Jul. 23, 2015

(65) Prior Publication Data

US 2016/0332184 A1 Nov. 17, 2016

Related U.S. Application Data

(60) Provisional application No. 61/929,391, filed on Jan. 20, 2014.

(51) Int. Cl.
*B05B 1/00* (2006.01)
*B05B 12/00* (2018.01)
(Continued)

(52) U.S. Cl.
CPC ..... *B05B 12/002* (2013.01); *B05B 9/0413* (2013.01); *B05B 9/0426* (2013.01);
(Continued)

(58) Field of Classification Search
CPC ... B05B 15/065; B05B 9/0413; B05B 9/0426; B05B 9/0861; B05B 12/002; B05B 15/06; B65D 47/063; B65D 83/303
(Continued)

(56) References Cited

U.S. PATENT DOCUMENTS 5,609,272 A * 3/1997 Brass ..... B05B 9/0816 222/147
5,651,908 A * 7/1997 Mansfield ..... B05B 9/0426 222/383.3

(Continued)

FOREIGN PATENT DOCUMENTS

CN 201140145 Y 10/2008

OTHER PUBLICATIONS

International Search Report and Written Opinion from PCT Application Serial No. PCT/US2015/011977, dated Apr. 29, 2015, 10 pages.

(Continued)

*Primary Examiner* — Steven J Ganey
(74) *Attorney, Agent, or Firm* — Kinney & Lange, P.A.

(57) ABSTRACT

A fluid sprayer comprises a fluid source, a spray nozzle, a pump, and a handle with a base. The spray nozzle is disposed to accept a spray tip with an outlet aperture. The pump is disposed to pump fluid from the fluid source out the outlet aperture of the spray tip. The base has a sealable storage slot sized to contain and form an air seal with the spray tip when not in use.

12 Claims, 2 Drawing Sheets

(51) Int. Cl.

| | |
|---|---|
| ***B65D 83/30*** | (2006.01) |
| ***B65D 47/06*** | (2006.01) |
| ***B05B 9/04*** | (2006.01) |
| ***B05B 9/08*** | (2006.01) |
| ***B05B 15/60*** | (2018.01) |
| ***B05B 15/14*** | (2018.01) |
| ***B05B 15/65*** | (2018.01) |

(52) U.S. Cl.
CPC ..... *B05B 9/0861* (2013.01); *B05B 15/14* (2018.02); *B05B 15/60* (2018.02); *B05B 15/65* (2018.02); *B65D 47/063* (2013.01); *B65D 83/303* (2013.01)

(58) Field of Classification Search
USPC ..... 239/71, 119, 340, 346, 390–397, 525, 239/600; 222/530, 538; 211/60.1, 69.1, 211/69.5
See application file for complete search history.

(56) References Cited

U.S. PATENT DOCUMENTS

| | | | | |
|---|---|---|---|---|
| 5,893,522 | A | 4/1999 | Kieffer | |
| 6,123,272 | A | 9/2000 | Havican et al. | |
| 6,202,862 | B1 * | 3/2001 | Acquaviva | B43K 21/003 211/60.1 |
| D474,529 | S * | 5/2003 | Sodemann | D23/223 |
| 6,651,909 | B1 * | 11/2003 | Bugarin | B08B 3/026 239/390 |
| 6,988,677 | B2 * | 1/2006 | Sodemann | B05B 15/06 239/390 |
| 8,656,756 | B2 * | 2/2014 | Mizutani | G01N 27/4077 73/23.2 |
| 2006/0196967 | A1 * | 9/2006 | Monty | B05B 1/00 239/73 |
| 2008/0197029 | A1 | 8/2008 | Feyereisen et al. | |
| 2010/0224700 | A1 | 9/2010 | Woodgate et al. | |
| 2011/0198413 | A1 | 8/2011 | Thompson et al. | |
| 2012/0145747 | A1 | 6/2012 | Knopow et al. | |
| 2014/0017025 | A1 | 1/2014 | Hemingway et al. | |
| 2017/0045072 | A1 * | 2/2017 | Hemingway | F16B 1/0014 |

OTHER PUBLICATIONS

First Office Action from the Chinese Patent Office for Application No. 2015800052263, dated Feb. 1, 2018, 12 pages.
Office Action from the Taiwan Patent Office for Application No. 104101839, dated Feb. 22, 2018, 13 pages.

* cited by examiner

SPRAY TIP STORAGE

BACKGROUND

The present invention relates generally to fluid spraying systems. More particularly, the invention relates to a tip storage compartment for a handheld fluid sprayer.

Fluid spraying systems are commonly used in a wide variety of applications, from industrial assembly to home painting. Handheld sprayers can be used by a human operator, while automated sprayers are typically used in mechanized manufacturing processes. It is common for handheld sprayers to accept a variety of spray tips configured to produce a variety of distinct spray patterns. During ordinary use, an operator may swap spray tips several times, as necessitated by task. Spray tips that are not in use are easily misplaced, and tend to dry rapidly. Spray tips coated or clogged with dried spray fluids (e.g. paint) can be difficult or impossible to clean. To prevent drying, spray tips are conventionally rinsed immediately after use.

SUMMARY

In a first embodiment, a fluid sprayer comprises a fluid source, a spray nozzle, a pump, and a handle with a base. The spray nozzle is disposed to accept a spray tip with an outlet aperture. The pump is disposed to pump fluid from the fluid source out the outlet aperture of the spray tip. The base has a sealable storage slot sized to contain and form an air seal with the spray tip when not in use.

In a second embodiment, a method of storing a spray tip of a fluid sprayer comprises aligning the spray tip with an aperture of a storage slot, and inserting the spray tip into the storage aperture. The storage slot is situated in a base of the fluid sprayer, and the aperture is formed through compliant material and has an aperture diameter less than a diameter of the spray tip. Inserting the spray tip deforms the compliant material to form an air seal of the storage slot via an interference fit.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale.

DETAILED DESCRIPTION

The present invention relates to a hand-held paint sprayer. The sprayer has a handle with a base having a sealable storage slot for a spray tip. The storage slot can house a spray tip while another spray tip is in use, and forms an air seal with the spray tip once inserted. This air seal retards drying of the spray tip, allowing for longer storage before spray fluid hardens on the spray tip.

Figure 1:
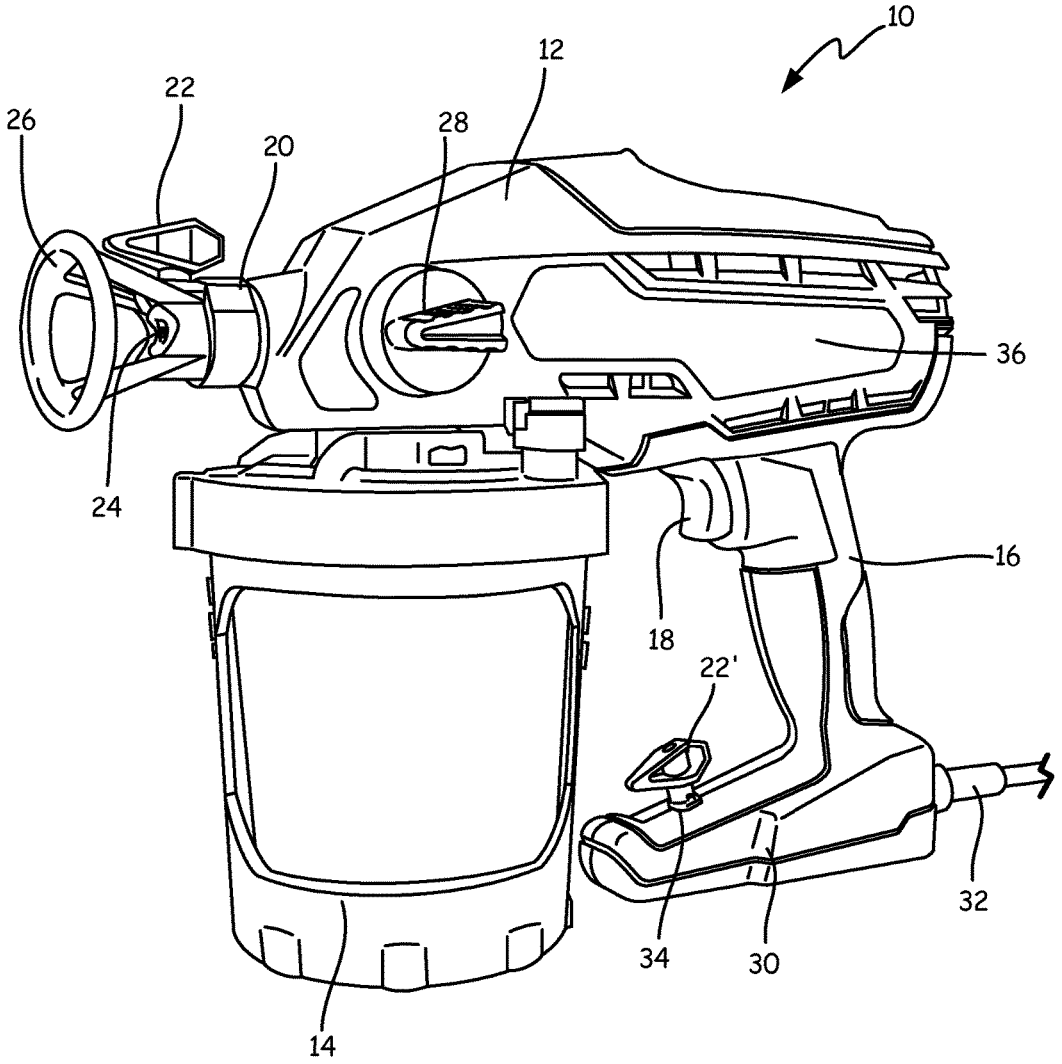
FIG. 1 is a perspective view of a fluid sprayer including a spray tip.

FIG. 1 is a perspective view of sprayer 10, a handheld fluid sprayer according to one embodiment of the present invention. Sprayer 10 includes body 12, source 14, grip 16, trigger 18, nozzle 20, spray tips 22 (with outlet aperture 24) and 22', guard 26, prime valve assembly 28, base 30, power cord 32, storage slot 34, and pump 36. In the depicted embodiment, sprayer 10 can, for example, be an electrical spray device for use with paint, solvent, or other fluids.

Body 12 of sprayer 10 includes pumping elements suitable to drive fluid from source 14 towards nozzle 20, and expel fluid from outlet aperture 24 of spray tip 22. In the depicted embodiment, body 12 houses pump 36. Pump 36 can, for example, be an electric motorized pumps that receives power through power cord 32, or from an integral battery pack (not shown). Grip 16 provides a hand-hold for a human user. When the user depresses trigger 18, sprayer 10 draws fluid from source 14 through body 12, and expels this fluid through nozzle 20. Trigger 18 can, for example, actuate pump 36. Although source 14 is depicted as a substantially cylindrical fluid receptacle carried by body 12, alternative embodiments of source 14 can include receptacles of other shapes and sizes, as well as fluid lines or hoses connectable to external fluid supplies. Source 14 can, for example, be a disposable paint container such as a deflating bag. Prime valve assembly 28 can be used to prime pumping elements within body 12 prior to spraying fluid from source 14.

Nozzle 20 is protected by guard 26, a rigid or semi-rigid positioning element. In the depicted embodiment, guard 26 is an elliptical frame situated forward of spray tip 22. Nozzle 20 houses spray tip 22. Spray tip 22 can, for example, be a removable element with a substantially cylindrical portion insertable into nozzle 20 to provide a desired spray pattern, as depicted and described in further detail below with respect to FIG. 2. Spray tip 22 includes outlet aperture 24, a ground or otherwise machined narrow aperture that atomizes spray fluid and defines a spray pattern. Sprayer 10 can accept various spray tips 22, e.g. spray tips 22 and 22' with different outlet apertures 24 capable of producing different spray patterns suitable for different applications. For example, a spray tip 22 that produces a wide spray pattern can be swapped out for a spray tip 22' that produces a narrow spray pattern when precision spraying is required. In the depicted embodiment, base 30 provides attachment point for power cord 32, and houses storage slot 34 for spray tip 22 or for one such reserve or alternate spray tip 22'. In the depicted embodiment, storage slot 34 opens outward towards nozzle 20, such that spray tips 22 and/or 22' are retained in storage slot 34 by gravity while sprayer 10 is in an upright position.

Figure 2A:
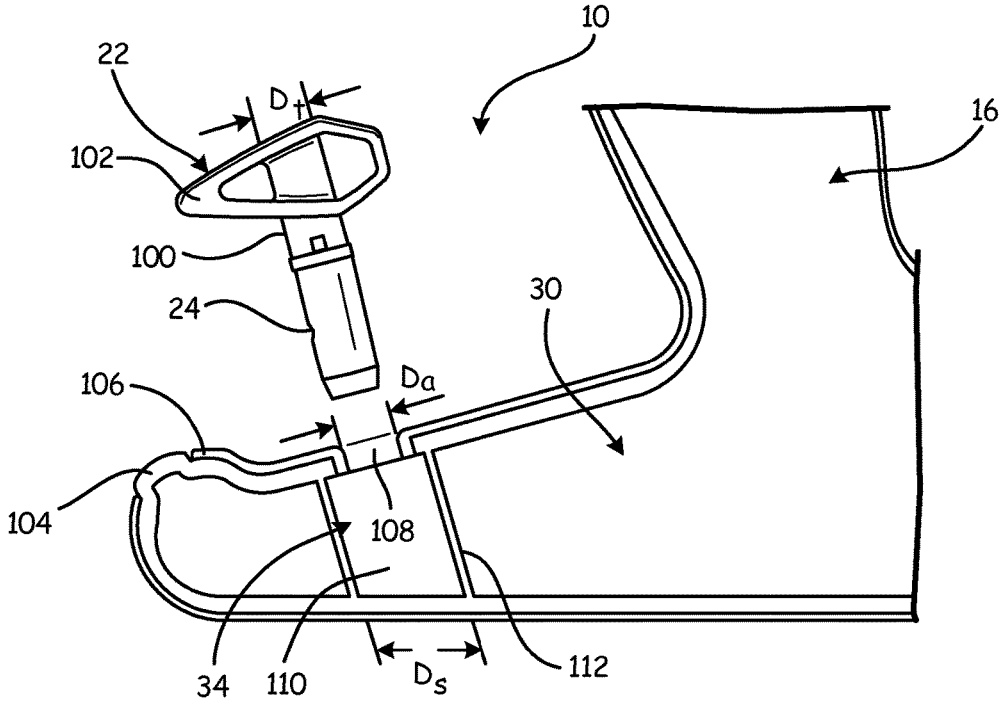
FIGS. 2*a* and 2*b* are cross-sectional views of the fluid sprayer of FIG. 1, with the spray tip adjacent (FIG. 2*a*) or inserted into (FIG. 2*b*) a sealable storage slot.
Figure 2B:
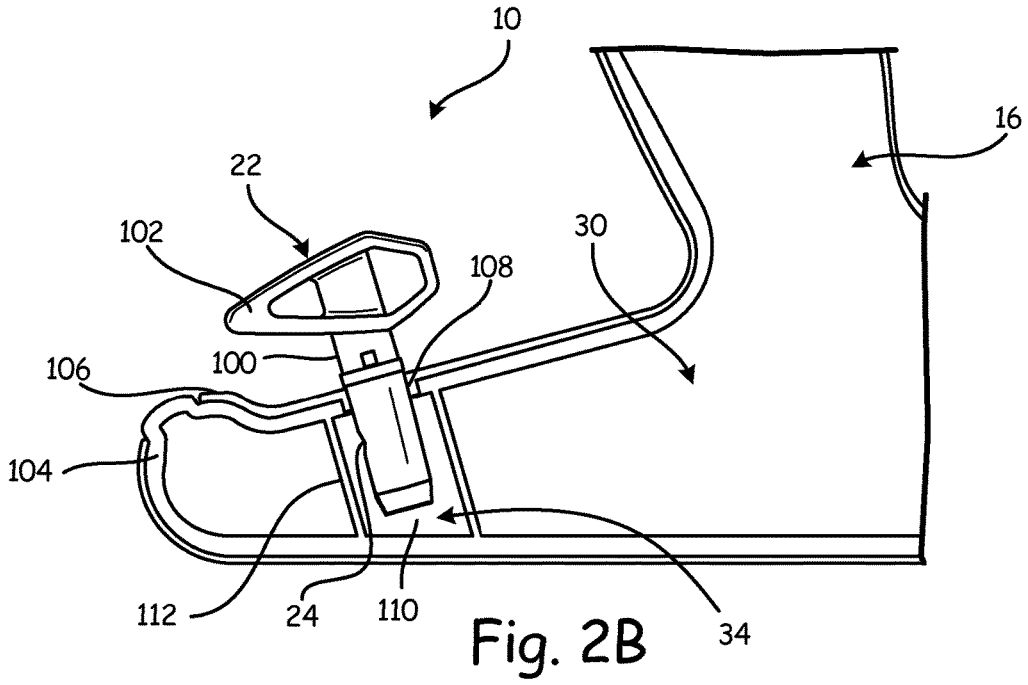

FIGS. 2*a* and 2*b* are cross-sectional views of a portion of sprayer 10 including handle 16 and base 30, with spray tip 22 in different positions. FIGS. 2*a* and 2*b* illustrate spray tip 22 (with cylindrical insert 100, outlet aperture 24, and grip tab 102), rigid body 104, overmolded layer 106, and storage slot 34 (with slot aperture 108, sealable chamber 110, and slot walls 112). FIG. 2*a* depicts spray tip 22 withdrawn a distance away from storage slot 34, whereas FIG. 2*b* depicts spray tip 22 inserted into storage slot 34.

In the depicted embodiment, spray tip 22 includes cylindrical insert 100 sized to fit into nozzle 20 (see FIG. 1). Outlet aperture 24 is situated through cylindrical insert 100, and is aligned for spraying when spray tip is inserted into nozzle 20. Spray tip 22 further comprises grip tab 102, which can be used by a human operator to insert, remove, or orient spray tip 22. Cylindrical insert 100 of spray tip 22 has spray tip diameter $D_t$ suited for insertion into nozzle 20.

Base 30 of handle 16 includes rigid body 104 and overmolded layer 106. Rigid body 104 is a structural body formed, e.g., of polymer. Overmolded layer 106 is a flexible layer e.g. of elastomer or pliable polymer overmolded atop rigid body 104. Overmolded layer 106 covers at least a portion of grip 16 and base 30, and provides an improved gripping surface on handle 16 for a human operator.

As discussed above with respect to FIG. 1, storage slot 34 is a slot or cavity in handle 30 configured to receive spray tip 22. Storage slot 34 is formed within rigid body 104. In the depicted embodiment, storage slot 34 comprises a sealable chamber 110 defined within rigid body 104 of base 30 by slot walls 112. Sealable chamber 110 can, for example, be a substantially cylindrical chamber with slot diameter $D_s>D_t$. A partial seal is provided by overmolded layer 106 at slot aperture 108. Slot aperture 108 has aperture diameter $D_a$, with $D_a<D_t$, such that inserting spray tip 22 into storage slot 34 forms an air seal isolating sealable chamber 110 against air ingress via an interference fit between overmolded layer 106 and spray tip 22. Slot aperture 108 is substantially centered between slot walls 112. Overmolded layer 106 deforms about slot aperture 108 to accommodate cylindrical insert 100 of spray tip 22. To enable this interference fit, aperture diameter $D_a$ can, for example, be less than spray tip diameter $D_t$ but greater than 90% of spray tip diameter $D_t$. In at least some embodiments, overmolded layer 106 covers a wide area of base 30 and grip 16 surrounding slot aperture 108, to avoid separation of overmolded layer 106 from rigid body 104.

In at least some embodiments, slot diameter $D_s$ is no greater than twice $D_t$, so as to reduce the volume of air trapped inside sealable chamber 110 when spray tip 22 is inserted into storage slot 34. By reducing the volume of trapped air, the rate at which spray tip 22 dries within storage slot 34 is substantially slowed. Similarly, the partial air seal provided by the interference fit between overmolded layer 106 and cylindrical insert 100 reduces air flow and correspondingly slows tip drying. In this way, storage slot 34 not only provides a convenient storage location for spray tips 22 (or 22') when not currently in use, but also obviates the need to immediately rinse stored spray tips after use to prevent spray fluid from drying and obstructing outlet apertures 24. Although only one storage slot 34 is depicted herein, alternative embodiments of the present invention can include more than one storage slot 34, so as to hold several spray tips 22 (or 22') simultaneously.

Discussion of Possible Embodiments

The following are non-exclusive descriptions of possible embodiments of the present invention.

A fluid sprayer comprises: a fluid source; a spray nozzle disposed to accept a spray tip with an outlet aperture; a pump disposed to pump fluid from the fluid source out the outlet aperture of the spray tip; a handle with a base; and a sealable storage slot in the base, sized to contain and form an air seal with the spray tip when not in use.

The fluid sprayer of the preceding paragraph can optionally include, additionally and/or alternatively, any one or more of the following features, configurations and/or additional components:

A further embodiment of the foregoing fluid sprayer, wherein the fluid tip has a first diameter, and the sealable storage slot has a second diameter greater than the first diameter but less than twice the first diameter.

A further embodiment of the foregoing fluid sprayer, wherein the sealable storage slot is partially covered by an overmolded layer of flexible material.

A further embodiment of the foregoing fluid sprayer, wherein the flexible material is a plastic or elastomer material.

A further embodiment of the foregoing fluid sprayer, wherein the overmolded layer has an aperture allowing the spray tip to be inserted through the overmolded layer into the storage slot.

A further embodiment of the foregoing fluid sprayer, wherein the aperture opens towards the spray nozzle.

A further embodiment of the foregoing fluid sprayer, wherein the overmolded layer forms the seal via an interference fit with the spray tip.

A further embodiment of the foregoing fluid sprayer, wherein the spray tip has a first diameter, and the aperture has a second diameter less than the first diameter but greater than 90% of the first diameter.

A further embodiment of the foregoing fluid sprayer, wherein the handle and the base are at least partially covered by the overmolded layer.

A further embodiment of the foregoing fluid sprayer, wherein the handle is formed of a rigid polymer.

A further embodiment of the foregoing fluid sprayer, wherein the spray tip comprises a grip tab situated at one end of a substantially cylindrical insert containing an outlet aperture.

A method of storing a spray tip of a fluid sprayer, the method comprising: aligning the spray tip with an aperture of a storage slot in a base of the fluid sprayer, the aperture being formed through compliant material and having an aperture diameter less than a diameter of the spray tip; inserting the spray tip into the storage aperture, thereby deforming the compliant material to form an air seal of the storage slot via an interference fit.

The method of the preceding paragraph can optionally include, additionally and/or alternatively, any one or more of the following features, configurations and/or additional components:

A further embodiment of the foregoing method, wherein the compliant material is elastomer or plastic.

A further embodiment of the foregoing method, wherein the compliant material forms a layer at least partially covering a grip and base of the sprayer.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid sprayer comprises:

a fluid source;

a spray nozzle disposed to accept a spray tip with an outlet aperture;

a pump disposed to pump fluid from the fluid source out the outlet aperture of the spray tip;

a handle with a base; and a sealable storage slot in the base, sized to contain and form an air seal with the spray tip when not in use, wherein the sealable storage slot is partially covered by a molded layer of flexible material, wherein the handle and the base are at least partially covered by the molded layer.

2. The fluid sprayer of claim 1, wherein the fluid tip has a first diameter, and the sealable storage slot has a second diameter greater than the first diameter but less than twice the first diameter.

3. The fluid spray of claim 1, wherein the molded layer of flexible material is overmolded to partially cover the sealable storage slot.

4. The fluid sprayer of claim 3, wherein the flexible material is a plastic or elastomer material.

5. The fluid sprayer of claim 3, wherein the overmolded layer has an aperture allowing the spray tip to be inserted through the overmolded layer into the storage slot.

6. The fluid sprayer of claim 5, wherein the aperture opens towards the spray nozzle.

7. The fluid sprayer of claim 5, wherein the overmolded layer forms the seal via an interference fit with the spray tip.

8. The fluid sprayer of claim 7, wherein the spray tip has a first diameter, and the aperture has a second diameter less than the first diameter but greater than 90% of the first diameter.

9. The fluid sprayer of claim 1, wherein the handle is formed of a rigid polymer.

10. The fluid sprayer of claim 1, wherein the spray tip comprises a grip tab situated at one end of a substantially cylindrical insert containing an outlet aperture.

11. A method of storing a spray tip of a fluid sprayer, the method comprising:

aligning the spray tip with an aperture of a storage slot in a base of the fluid sprayer, the aperture being formed through compliant material and having an aperture diameter less than a diameter of the spray tip; and inserting the spray tip into the aperture, thereby deforming the compliant material to form an air seal of the storage slot via an interference fit, wherein the compliant material forms a layer at least partially covering a grip and base of the sprayer.

12. The method of claim 11, wherein the compliant material is elastomer or plastic.

* * * * *